US009622521B1

(12) United States Patent
Clayton

(10) Patent No.: US 9,622,521 B1
(45) Date of Patent: Apr. 18, 2017

(54) IMPACT-RESISTANT PADDING

(71) Applicant: Anthony B. Clayton, Wilmington, DE (US)

(72) Inventor: Anthony B. Clayton, Wilmington, DE (US)

( * ) Notice: Subject to any disclaimer, the term of this patent is extended or adjusted under 35 U.S.C. 154(b) by 0 days.

(21) Appl. No.: 14/150,776

(22) Filed: Jan. 9, 2014

Related U.S. Application Data

(60) Provisional application No. 61/848,777, filed on Jan. 11, 2013.

(51) Int. Cl.
*A41D 13/015* (2006.01)
*A41D 13/05* (2006.01)
*A41D 13/08* (2006.01)

(52) U.S. Cl.
CPC ..... *A41D 13/0543* (2013.01); *A41D 13/015* (2013.01); *A41D 13/0512* (2013.01); *A41D 13/0518* (2013.01); *A41D 13/08* (2013.01)

(58) Field of Classification Search
CPC .. A41D 13/065; A41D 13/0556; A41D 13/08; A41D 13/015; A41D 13/0518; A41D 13/0543; A41D 13/0512; A63B 2071/125
USPC ..... 2/16, 22, 23, 24, 267
See application file for complete search history.

(56) References Cited

U.S. PATENT DOCUMENTS 562,608 A * 6/1896 Herbelin ..... 2/24
563,468 A * 7/1896 Fergusson ..... 2/24
588,907 A * 8/1897 Herbelin ..... 2/24
832,536 A * 10/1906 Coupe ..... 2/24
932,990 A * 8/1909 Madill ..... 2/227
1,081,245 A * 12/1913 McCall ..... 2/24
1,945,226 A * 1/1934 Lutsche ..... 54/82
2,589,636 A * 3/1952 Smith ..... 2/459
3,168,746 A * 2/1965 Smith ..... 2/24
4,120,052 A * 10/1978 Butler ..... 2/16
4,476,258 A 10/1984 Hiles
4,808,469 A 2/1989 Hiles
4,831,666 A * 5/1989 Denman ..... 2/23
4,953,569 A * 9/1990 Lonardo ..... 128/892
5,018,221 A 5/1991 Romandetto
5,255,391 A * 10/1993 Levine ..... 2/24
5,594,954 A * 1/1997 Huang ..... 2/24
5,925,010 A * 7/1999 Caprio, Jr. ..... 602/62
6,122,768 A * 9/2000 McCrane ..... 2/16
(Continued)

OTHER PUBLICATIONS

"Pads" from *Wikipedia, the free encyclopedia* http://en.wikipedia.org/wiki/Pads; accessed on Jul. 3, 2012.

(Continued)

*Primary Examiner* — Danny Worrell
(74) *Attorney, Agent, or Firm* — Ramberg IP

(57) ABSTRACT

An article of apparel for a human being, designed or arranged to be worn around an appendage such as an arm or leg, and designed or intended to resist impact. The article contains a material in the form of a spongy, elastic polymer engineered to absorb energy, shock, vibration and impact. The article of apparel can be used to protect hard, bony areas of the human body such as elbows, knees and ankles. The article will be of use to persons engaged in sports involving bats, sticks, mallets, pucks and hard balls, as well as to cyclists, and anyone whose occupation requires the knees or elbows to come into contact with hard surfaces.

21 Claims, 5 Drawing Sheets

(56) References Cited

U.S. PATENT DOCUMENTS

2003/0236044 A1 12/2003 Nissim et al.

OTHER PUBLICATIONS

"Shin guard" from *Wikipedia, the free encyclopedia* http://en.wikipedia.org/wiki/Shin_guard; accessed on Jul. 3, 2012.
"Unique Urethane Dampens Shocks and Noise", Doug Smock, ed., *Design News*, Aug. 13, 2009.
http://www.sorbothane.com/blog/vibration-isolation-pads/; accessed on Nov. 25, 2010.
http://www.sorbothane.com/blog/shock-absorbing-material/; accessed on Nov. 25, 2010, and re-accessed on Jun. 26, 2014.

* cited by examiner

IMPACT-RESISTANT PADDING

CROSS-REFERENCE TO RELATED APPLICATION

This patent document claims the benefit of U.S. Provisional Patent Application No. 61/848,777, filed on Jan. 11, 2013 in the name of Anthony B. Clayton and entitled, "IMPACT-RESISTANT PADDING". The entire contents of this commonly owned patent application are expressly incorporated by reference.

STATEMENT REGARDING FEDERALLY SPONSORED RESEARCH

None.

BACKGROUND OF THE INVENTION

1. Field of the Invention

The instant invention relates to padding or articles containing padding, and that are intended to be worn on the human body, and are designed to protect the wearer from impact and mechanical shock.

2. Discussion of Related Art

Much of the sports padding for sports such as football, cricket and ice hockey is bulky, cumbersome or uncomfortable. Typically, this padding consists of a hard, rigid plastic shell or armor, with a foamed elastic polymer such as polyurethane underneath. An elastic or otherwise adjustable strap extends form one side of the padded device to the other, and typically wraps around a body appendage or the head. Typically, the foamed elastic polymer material is in direct contact with the wearer's clothing or skin.

Further, this padding has not substantially changed in form or material in several decades. In short, the current sports padding could be improved in terms of its comfort and protective abilities. In the game of baseball, for example, the batter is at risk of injury from being hit with the baseball thrown by the pitcher. The batter's head is somewhat protected by the batting helmet but a lot of foul balls typically strike the shin or ankle.

The game of cricket also involves batting a thrown ball. While the ball is bounced at the batter by the bowler, there is still the risk of injury to the shins, ankles, knees and feet. To that end, there has been provided strong boots to protect the feet and thick, reinforced padding to protect the legs.

Even impact from one's own body poses an injury risk. In running, for example, the feet are exposed to decelerations of about 15 to 20 times the force of gravity. Accordingly, running shoes have been designed with polyethylene foams to reduce these decelerations, but these typically take on a compression set of 25 to 30 percent, and after a few days use, typically exhibit a permanent set of almost 70 percent of their original thickness. Their shock absorbing ability suffers as a result. The shock or energy absorbing material also needs to have a low specific gravity so that the article of apparel is not unduly heavy. Further, where the impacts are periodic or frequent, the shock-absorbing material needs to rebound or recover ("spring back") its original shape quickly.

SUMMARY OF THE INVENTION

In accordance with the instant invention, material that is designed to absorb energy, shock, vibration and/or impact ("ESVI") is applied to human wearing apparel or is shaped or arranged as a device designed to protect selected areas of the human body such as shoulders, chins, chest, arms and legs, and more specifically, the elbows, wrists, knees, shins and ankles. In general, the areas of the body to be protected are bones and joints, and particularly where bones are near the surface, and there is not much flesh or muscle to protect the bone in the way of a natural padding.

The ESVI material may be a spongy, elastic polymer, although it is not a foam, nor is it even necessarily porous. It may be provided as one or more layers of a laminate having sufficient length and width to essentially completely cover the selected area of the body. The ESVI material may be colored, e.g., by dyeing. The other layer(s) in the laminate may include at least one layer of cotton double knit material arranged to contact the body, and/or at least one layer of durable fabric facing outward, that is, away from the wearer's body. A device incorporating the ESVI material also includes at least a means for temporarily positioning the laminate against the body, such as one or more straps. In the elbow guard, for example, the straps may be located above and below the elbow. In another embodiment, the positioning means may be in the form of a neoprene or similar elastic sleeve, or a pair of such sleeves, that can fit snugly over an appendage such as an arm or leg for protection of wrists, elbows, ankles, shins or knees. The ESVI-containing material is located between each sleeve, and attached to each.

DETAILED DESCRIPTION OF THE INVENTION

Figure 1:
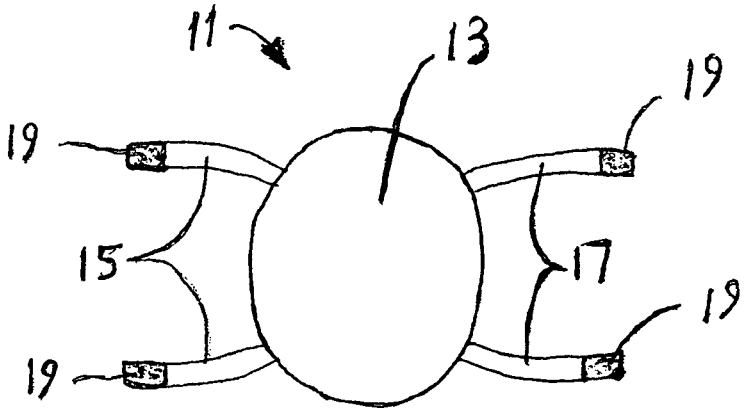
FIG. 1 is a front or top view of an elbow or knee pad.

In accordance with the instant invention, material that is designed to absorb mechanical energy, shock, vibration and/or impact (hereinafter referred to as "ESVI") is shaped or arranged as a device designed or intended to be worn by a human being such as a person playing a sport or athletic game. The device is applied to a vulnerable area of the body where protection is sought, such as bones and joints, and particularly where such bones and joints are near the surface of the skin. A temporary placement or attachment means holds the ESVI absorbing material in place against the region of the body to be protected. For purposes of this disclosure, a material will be considered to be a ESVI material if, in its particular application, it can absorb at least 50% of the shock imposed. Preferably, the material is a spongy, but not necessarily porous, elastic polymer.

Most of the prior art ESVI materials are porous or "foamed" highly elastic polymers. During the impact event, these materials absorb energy by temporarily collapsing the pores. Afterward, the material rebounds or springs back to its original shape. To accommodate the collapse, the foamed material must be provided in relatively thick form, which reduces flexibility and dexterity. Further, the pores present a large surface area for the deposit and growth of bacteria and fungi, which presents a health hazard, develops foul odors, and makes the material difficult to clean.

Non-porous or essentially non-porous ESVI materials are also known, but one prior art document that teaches a number of applications of such materials nevertheless does not teach using the material by itself, but instead advocates using it in combination or "compositing" with the well-known porous elastic polymers. Thus, embodiments of the present invention represents an advance over the known art in that the ESVI absorbing function can be provided by the (essentially) non-porous ESVI material by itself, without having to also provide porous polymer materials. The non-porous nature of the present ESVI material renders it more sanitary and easier to clean.

A preferred ESVI material is an elastomeric polyurethane and more particularly is a thermoset, polyether-based polyurethane material sold under the trademark SORBOTHANE (Sorbothane Company, Kent, Ohio) and described in U.S. Pat. No. 4,476,258, whose entire contents are herewith incorporated by reference. This particular polyurethane elastomer has a density between about 0.4 and about 1 gram per cubic centimeter, a compression set of less than about 5 percent, and a recovery time of between about 10 and about 100 milliseconds. It contains a light-weight filler material as a reinforcement. This elastomer is described as the reaction product of a compound containing at least four urethane-forming reactive sites which are capable of forming stable complexes through unsatisfied urethane-forming reactive sites, an elasticizing polyol, and a diisocyanate added in less than a stoichiometric amount. A portion of the elasticizing polyol may be replaced by a suitable plasticizer, and the reaction may be catalyzed by material that also provide ionic species for stabilization of unreacted urethane-forming reactive sites though chelation.

The above-mentioned U.S. Pat. No. 4,476,258 is also directed to a method of producing the shock-absorbing composition, the method featuring as a first step, mixing a compound having at least four urethane-forming sites and capable of forming stable complexes through unsatisfied urethane-forming reactive sites, an elasticizing polyol, preferably a diol or triol, a plasticizer, and a light-weight reinforcing filler material. To this mixture is added the diisocyanate in less than stoichiometric amounts. The reactants are then allowed to form the urethane linkages involving less than 80% of the urethane-forming reactive sites on the quadra-functional reactant, followed by stabilizing the remaining urethane-forming reactive sites by formation of complexes to provide a cured product having a density from about 0.4 to about 1 gram per cc, a compression set of less than about 5%, and a recovery time of from about 10 to about 100 milliseconds.

The ESVI material may be provided in thin form, e.g., in thicknesses on the order of about ⅛ inch (about 3 mm). Where greater protection is needed, thicknesses between about ⅛ and about ¼ inch (about 6 mm) may be provided. In some sports or specific sports the ball or projectile may be harder, so ESVI thicknesses up to ½ inch (12 mm) or even up to 1 inch (25 mm) may be called for. Further, or alternatively, the ESVI material may be provided as a plurality of pieces such as strips or pads instead of a monolithic or single sheet. Still further or alternatively, a strip of sheet of the ESVI material may be segmented, for example, with periodic perforations or cuts that do not completely separate the strip or sheet into multiple pieces, but merely permit the strip or sheet to be bent or twisted with less resilience or resistance.

Where there is a risk of penetrating or crushing type injury, for example, from a stick, bat, boot, puck or hard ball such as a baseball or cricket ball, the approach known in the art has been to place a rigid armor such as hard plastic, on top of, that is, exterior to the padding. In contrast, and in accordance with embodiments of the present invention, in place of a rigid armor, a durable fabric such as duck cloth or an elastomer such as neoprene can adequately substitute for the rigid plastic, thereby reducing weight and increasing range of movement of the wearer. Here, the ESVI material is located between the duck cloth and the wearer.

The temporary attachment means may be any that are known in the art. This non-exhaustive list includes adhesives such as adhesive tape, straps such as leather or elastic straps, or fasteners such as zippers, hooks, buttons and snaps. Alternatively, the temporary attachment means may include an elastic sleeve arranged to fit snugly over a body appendage such as an arm or leg, or portion thereof.

Referring now to the figures, where like numbers identify and describe like parts, FIG. 1 is a front or top view of one embodiment of the instant invention. In particular, FIG. 1 is a front or top view of an elbow or knee pad 11. The body of the pad 13 features a laminate structure featuring an ESVI material such as SORBOTHANE placed between, and optionally bonded to, layers of fabric. The laminate will be further discussed in connection with FIG. 2, below. Extending from the left and right sides of the pad are a pair of straps 15, 17 for temporarily or releaseably fastening the pad to the wearer. The straps may be adjustable so a single size of pad can fit a variety of wearers of differing sizes. The terminal ends of the straps contain the fasteners 19 such as a VELCRO hook-and-loop attachment system. All known means for temporarily attaching the pad to the human wearer are deemed to be within the scope of the invention. Both pads (elbow and knee) have the same general shape; their only significant difference is in their respective sizes.

Figure 2:
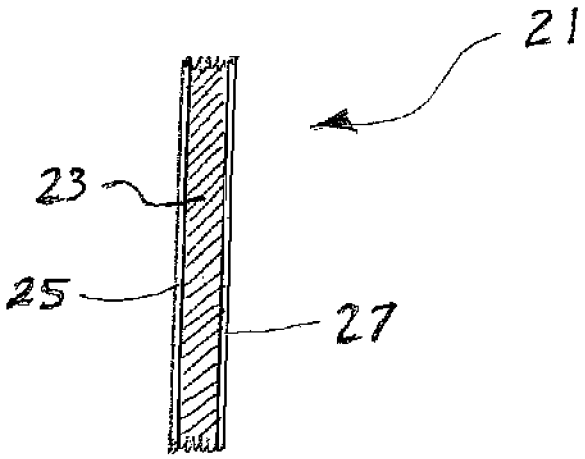
FIG. 2 is a cross-sectional view of a representative protective pad.

Referring now to FIG. 2, what is shown is a cross-sectional view of a representative protective pad 21. For simplicity of illustration, the attachment straps are not shown. FIG. 2 shows a laminate structure, with an ESVI material 23 such as SORBOTHANE sandwiched between two layers of fabric. The fabric at the left-hand edge 25 is a durable fabric such as canvas or canvas-like material, e.g., duck cloth. In normal use of the pad, this fabric layer 25 is intended to be the surface that is not in contact with the wearer; that is, it is intended to face the external environment. It is fashioned from rugged fabric because it is anticipated to take the brunt of impacts, blows, etc. from hard sports balls, sticks, rackets, mallets, etc. The fabric at the right-hand edge 27 is a softer fabric such as a cotton double-knit. In normal use of the pad, this fabric layer 27 is intended to be in contact with the skin or clothing of the wearer.

Figure 3:
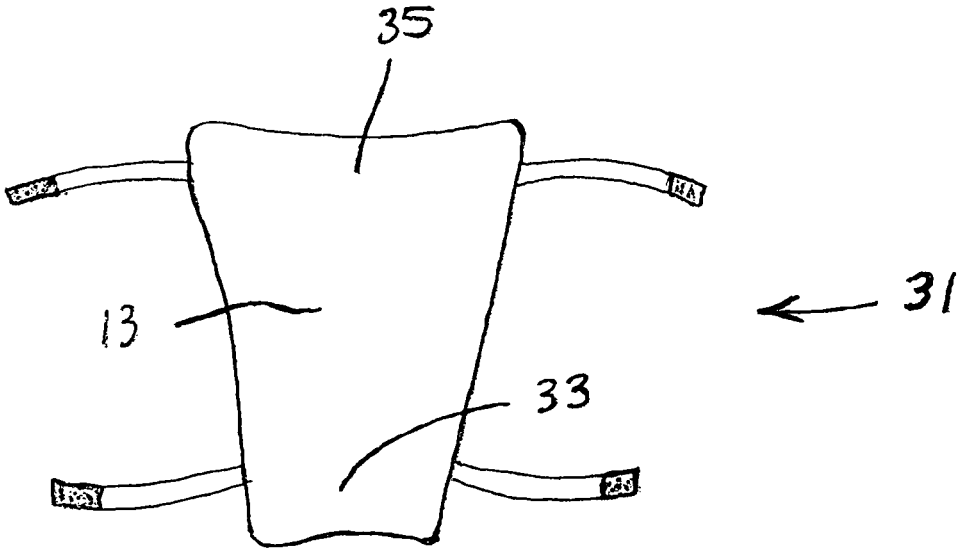
FIG. 3 is a front or top view of a shin pad.

FIG. 3 is a front or top view of a shin pad 31. Body 13 features a narrower region 33 and a wider region 35. In normal use, body 13 faces forward, with the straps and their fasteners fastening behind the leg. Narrower region 33 is positioned on the shin closer to the foot than wider region 35.

Figure 4:
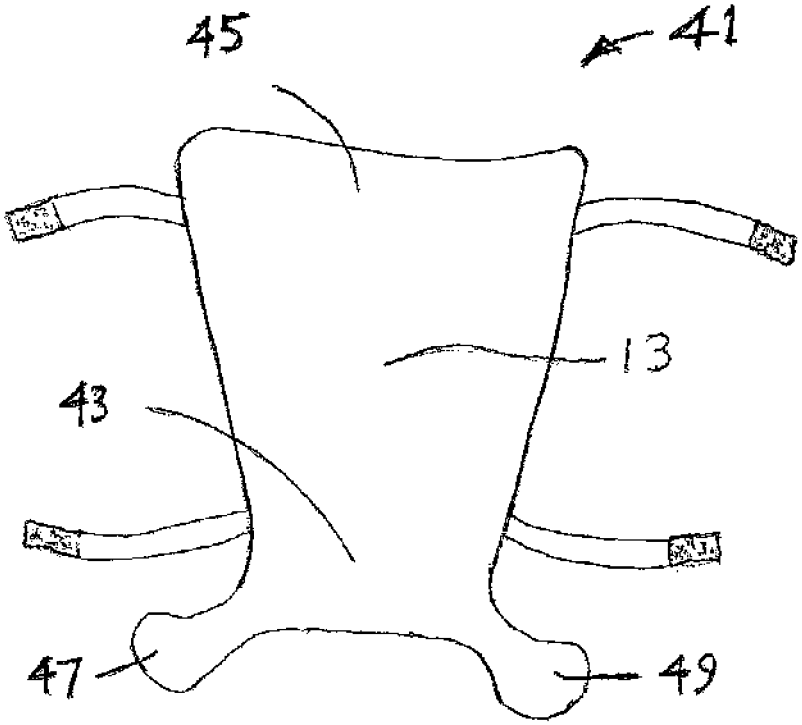
FIG. 4 is a front or top view of a combined shin and ankle pad.

FIG. 4 is a front or top view of a combined shin and ankle pad 41. This pad is worn in substantially the same manner as is shin pad 31; that is, with body 13 facing substantially forward, and region 43 being closer to the foot than region 45. This pad design also features wings 47 and 49 that are designed or arranged to cover the inner and outer ankle bones.

Figure 5:
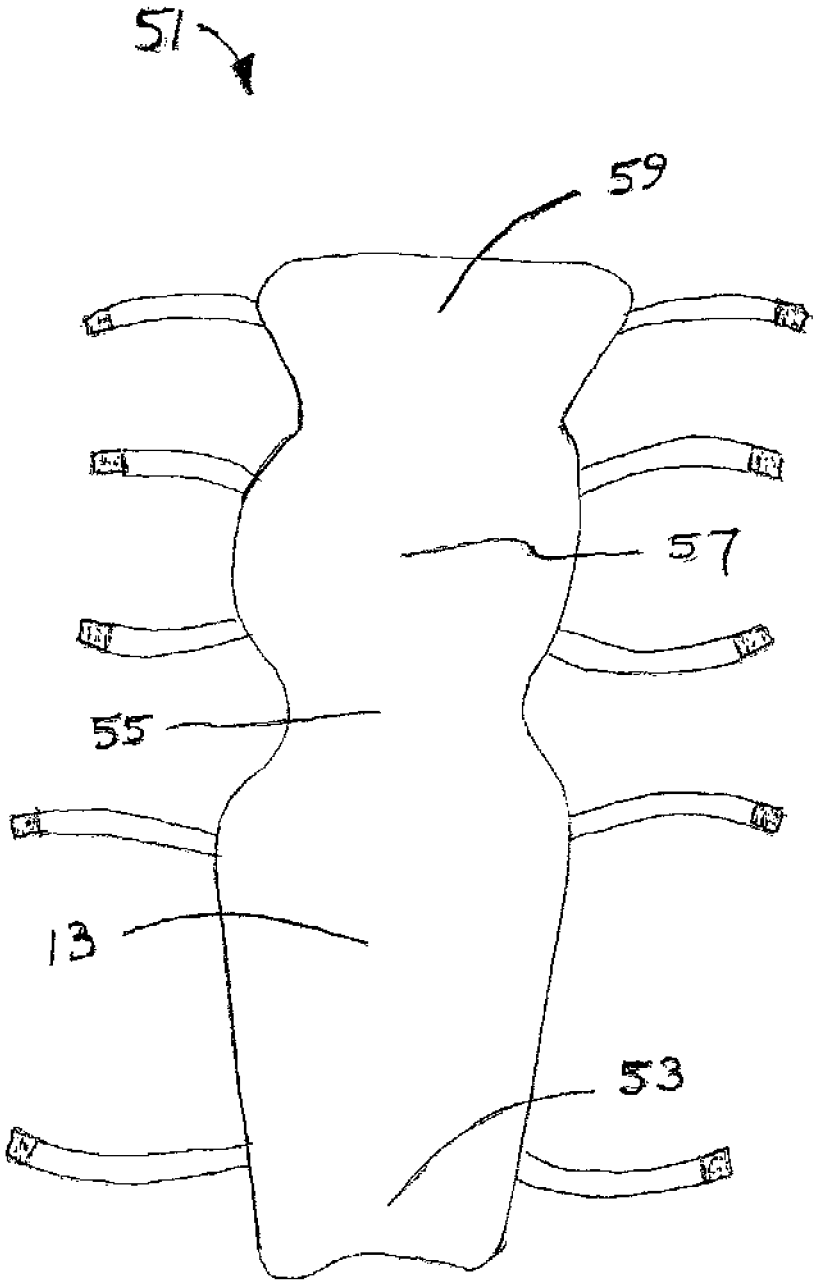
FIG. 5 is a front or top view of a cricket lag pad, respectively.

FIG. 5 is a front or top view of a cricket leg pad 51. Body 13 again generally faces forward. This pad is intended to cover substantially the entire lower leg, with region 53 being close to the foot at the lower end of the shin, region 55 fitting just below the knee, region 57 covering the knee, and region 59 extending somewhat above the knee.

Figure 6:
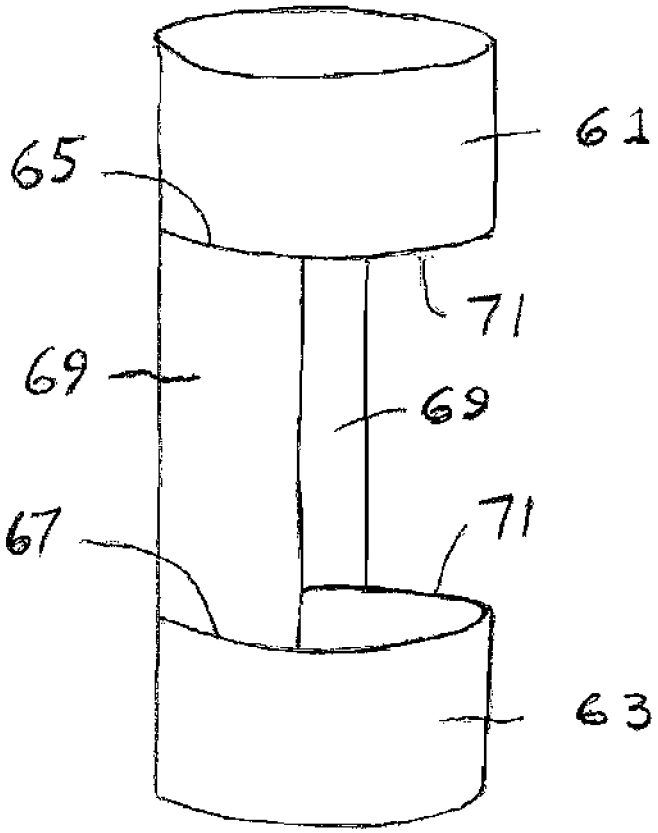
FIG. 6 is an isometric view of a pair of elastomer sleeves with an ESVI-containing sheet positioned between the pair, but not extending completely around the circumference.
Figure 7:
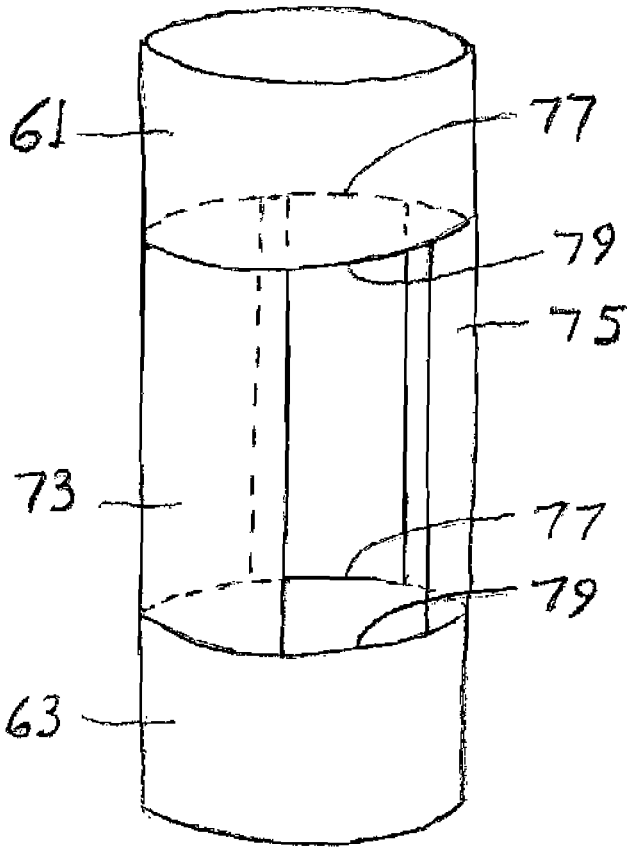
FIG. 7 is an isometric view of a pair of elastomer sleeves with two ESVI-containing sheets positioned between the pair, and leaving not one but two gaps around the circumference. All of the figures are according to the instant invention.

FIGS. 6 and 7 depict embodiments in which the ESVI material is placed between a pair of elastomeric bands or sleeves 61, 63 and attached to at least a portion of one of the circumferential edges 65, 67 of each sleeve. Here, the sleeves are relatively wide. In FIG. 6, a single sheet 69 containing ESVI material is used, but it does not extend around the entire circumference. Thus, it leaves a single gap or region 71 along the circumference where there is no sheet material 69. In FIG. 7, two sheets 73, 75 of ESVI-containing material are used, but again, the sheets do not extend all the way around the circumference. Here, though, there are two gaps or regions 77, 79 along the circumference of the elastomeric sleeves 61, 63 where there is no sheet material present. The sheet material may consist essentially of the ESVI material, or it may take the form of a laminate of ESVI material backed by soft fabric or hard/durable fabric, or both, such as soft fabric on the inside surface of the sheet material, and hard/durable fabric on the surface that faces out.

INDUSTRIAL APPLICABILITY

The instant invention of a pliable, impact ameliorating pad should find utility in a variety of sports or activities such as ice hockey, football, cricket, baseball, volleyball, lacrosse, field hockey, soccer and bicycling. In addition, the knee and elbow or similar pads may also find utility in the construction trades, for example, in those jobs where considerable time is spent bended down on one or both knees, such as masonry, roofing or flooring work. Other construction jobs may require supporting the upper body on the elbows.

Among the advantages of the present invention over the known products is increased comfort, which derives from one or more of increased breathability, reduced thickness, reduced weight and use of a soft fabric that is to be in contact with the skin or clothing of the wearer to provide comfort. Other improvements over known products include more protection for the same thickness, or the same protection for a reduced thickness.

Moreover, the inventor has discovered that protecting the exterior or outward-facing aspect of the ESVI material with durable fabric such as canvas is adequate or sufficient in most applications to prevent the ESVI material from being torn, ripped, penetrated or stabbed. Thus, in these applications, the device can dispense with the hard, rigid plastic. Here, the device has greater flexibility than prior devices featuring the rigid plastic. As such, wearers will experience greater freedom-of-movement, and thus greater athletic performance is likely, particularly if the protective device also features reduced weight and/or reduced thickness. Further on this point and in comparison, unlike the prior devices having rigid plastic, those of the present invention do not have to be hand-laundered. Instead, they can be machine-washed and dried using existing commercially available washers and dryers.

Another potential application or advantage over known products is in the field of medicine. Specifically, the device of the instant invention may have applications for protecting injured parts of the body. In particular, the instant device may protect such injured areas from further injury or re-injury, such as from impacts or dislocations. Simultaneously, for cuts, abrasions and other wounds, the breathability property of the present device is desirable and beneficial for encouraging scabbing and the tissue repair process.

An artisan of ordinary skill will appreciate that various modifications may be made to the invention herein described without departing from the scope or spirit of the invention as defined in the appended claims.

What is claimed is:

1. An article arranged to be worn by a human being as protection of a region of the body other than the skull, hands and feet vulnerable to injury from mechanical shock, vibration or impact, said article comprising:

(a) at least one releasably attachable pad arranged to contact an area of the body;

(b) said pad comprising a laminate having sufficient length and width to essentially completely cover a zone of the area to be protected, said laminate comprising (i) at least one layer of a soft fabric arranged to contact the body, (ii) at least one fabric selected from the group consisting of canvas and duck cloth, and (iii) an energy/shock/vibration/impact (ESVI)-absorbing material located between said at least one soft fabric and said at least one fabric; and (c) a means for temporarily attaching said laminate to the body of the human being; and (d) wherein said ESVI-absorbing material (i) is non-porous and (ii) comprises a polyurethane elastomer that is a reaction product of a compound containing at least four urethane-forming reaction sites that are capable of forming stable complexes through unsatisfied urethane-forming reactive sites, an elasticizing polyol, and a diisocyanate added in less than a stoichiometric amount.

2. The article of claim 1, wherein said polyurethane elastomer possesses the following physical properties: (i) a density from about 0.4 to about 1 gram per cc, (ii) a compression set of less than 5%, and (iii) a recovery time of from about 10 to about 100 milliseconds.

3. The article of claim 1, wherein said polyurethane elastomer is attached to at least one of said layer of soft fabric and said layer of fabric.

4. The article of claim 1, wherein said polyurethane elastomer is held in place between said fabric layers by means of a cover.

5. The article of claim 1, wherein said polyurethane elastomer is held in place between said fabric layers by stitching said fabric layers to one another to form a pocket or housing.

6. The article of claim 1, wherein said polyurethane elastomer is not more than ⅛ inch thick.

7. The article of claim 1, wherein said polyurethane elastomer ranges from about ⅛ inch to about ¼ inch thick.

8. The article of claim 1, wherein said polyurethane elastomer is provided in a plurality of pieces.

9. The article of claim 1, wherein said polyurethane elastomer is provided in a plurality of strips or pads.

10. The article of claim 1, wherein said polyurethane elastomer is provided as a plurality of segments attached to one another along a common side or edge.

11. The article of claim 1, wherein said soft fabric comprises cotton double knit material.

12. The article of claim 1, wherein said temporary attaching means comprises at least one of an elastic sleeve and at least one strap.

13. The article of claim 1, further comprising being machine-washable.

14. The article of claim 1, further comprising being machine-dryable.

15. The article of claim 1, wherein the area of the body is selected from the group consisting of an ankle, shin, knee, thigh, chest, shoulder, elbow, wrist and chin.

16. An article arranged to be worn by a human being as protection of an appendage of the body, and vulnerable to injury from mechanical shock, vibration or impact, said article comprising:

(a) at least one releasably attachable pad arranged to contact an area of the body;

(b) said pad comprising a laminate having sufficient length and width to essentially completely cover a zone of the area to be protected, said laminate comprising (i) at least one layer of a soft fabric arranged to contact the body, (ii) a non-porous ESVI-absorbing layer, and (iii) a layer facing out that is protective against penetration or crushing injury, said protective layer comprising a fabric having a durability of canvas;

(c) a means for temporarily attaching said laminate to the body of the human being; and (d) wherein said non-porous ESVI-absorbing layer comprises a polyurethane elastomer comprising the cured product of a reactant having at least four urethane-forming reaction sites, wherein less than 80% of said sites comprise urethane linkages, and further wherein a remaining portion of said sites are stabilized by formation of complexes.

17. An article arranged to be worn by a human being as protection of a limb of the body, and vulnerable to injury from mechanical shock, vibration or impact, said article comprising:

(a) at least one releasably attachable pad arranged to contact an area of the body;

(b) said pad comprising a laminate having sufficient length and width to essentially completely cover a zone of the area to be protected, said laminate comprising (i) at least one layer of a soft fabric arranged to contact the body, (ii) an ESVI-absorbing material, and (iii) at least one layer of a fabric selected from the group consisting of canvas and duck cloth; and (c) a means for temporarily attaching said laminate to the body of the human being; and (d) wherein said ESVI-absorbing material is non-porous and comprises a polyurethane elastomer that possesses the following physical properties: (i) a density from about 0.4 to about 1 gram per cc, (ii) a compression set of less than 5%, and (iii) a recovery time of from about 10 to about 100 milliseconds.

18. The article of claim 17, wherein said layer of at least one polyurethane elastomer is not more than ¼ inch thick.

19. The article of claim 16, further comprising being machine-dryable.

20. The article of claim 17, further comprising being machine-dryable.

21. The article of claim 1, wherein said ESVI-absorbing material comprising polyurethane elastomer is polyurethane elastomer.

* * * * *